US010677236B2

(12) United States Patent
Huetter

(10) Patent No.: US 10,677,236 B2
(45) Date of Patent: Jun. 9, 2020

(54) COMPRESSOR

(71) Applicant: KAESER KOMPRESSOREN SE, Coburg (DE)

(72) Inventor: Sebastian Huetter, Meeder (DE)

(73) Assignee: KAESER KOMPRESSOREN SE, Coburg (DE)

( * ) Notice: Subject to any disclaimer, the term of this patent is extended or adjusted under 35 U.S.C. 154(b) by 452 days.

(21) Appl. No.: 15/105,819

(22) PCT Filed: Dec. 17, 2014

(86) PCT No.: PCT/EP2014/078112
§ 371 (c)(1),
(2) Date: Jun. 17, 2016

(87) PCT Pub. No.: WO2015/091587
PCT Pub. Date: Jun. 25, 2015

(65) Prior Publication Data

US 2016/0319809 A1 Nov. 3, 2016

(30) Foreign Application Priority Data

Dec. 17, 2013 (EP) ..... 13197728

(51) Int. Cl.
*F04B 41/02* (2006.01)
*F04B 49/20* (2006.01)
(Continued)

(52) U.S. Cl.
CPC ..... *F04B 41/02* (2013.01); *F04B 35/04* (2013.01); *F04B 35/06* (2013.01);
(Continued)

(58) Field of Classification Search
CPC ..... F04B 41/02; F04B 35/04; F04B 35/06; F04B 39/0005; F04B 39/0094; F04B 39/12; F04B 39/128; F04B 49/20; F04B 51/00
(Continued)

(56) References Cited

U.S. PATENT DOCUMENTS 4,854,829 A * 8/1989 Stanzani ..... F04B 35/04 417/360
5,370,504 A * 12/1994 Nagashima ..... F04B 27/02 417/234
(Continued)

FOREIGN PATENT DOCUMENTS

WO 2007/041818 A1 4/2007

OTHER PUBLICATIONS

International Search Report dated Mar. 23, 2015 issued in corresponding PCT/EP2014/078112 application (2 pages).
(Continued)

*Primary Examiner* — Connor J Tremarche
(74) *Attorney, Agent, or Firm* — Millen, White, Zelano & Branigan, P.C.; William Nixon

(57) ABSTRACT

A compressor includes a motor, a drive shaft driven by the motor and connected thereto, a crank mechanism connected to the drive shaft, at least one compressed-air generation apparatus that is driven by the crank mechanism and is designed to generate compressed air, a crankcase that has an inner chamber wall in the shape of a hollow body, which receives the drive shaft at least in portions, an outer chamber wall that is spaced apart from the inner chamber wall radially with respect to the drive shaft, and a dividing wall, and a compressed-air storage container that is designed to receive compressed air generated by the compressed-air generation apparatus. The compressed-air storage container
(Continued)

is formed by the inner chamber wall, the outer chamber wall, the end wall and the dividing wall.

18 Claims, 5 Drawing Sheets

(51) Int. Cl.

| | |
|---|---|
| ***F04B 39/12*** | (2006.01) |
| ***F04B 51/00*** | (2006.01) |
| ***F04B 35/04*** | (2006.01) |
| ***F04B 39/00*** | (2006.01) |
| ***F04B 35/06*** | (2006.01) |

(52) U.S. Cl.
CPC ..... *F04B 39/0005* (2013.01); *F04B 39/0094* (2013.01); *F04B 39/12* (2013.01); *F04B 39/128* (2013.01); *F04B 49/20* (2013.01)

(58) Field of Classification Search
USPC ..... 417/415
See application file for complete search history.

(56) References Cited

U.S. PATENT DOCUMENTS

| | | | | |
|---|---|---|---|---|
| 6,089,835 | A | 7/2000 | Suzuura et al. | |
| 6,148,716 | A * | 11/2000 | Swank | F01B 1/08 92/137 |
| 2005/0053483 | A1* | 3/2005 | Iimura | F04B 41/02 417/321 |
| 2007/0075673 | A1* | 4/2007 | Nakazawa | H02K 21/14 318/712 |
| 2008/0173171 | A1* | 7/2008 | Brower | F02F 1/002 92/261 |
| 2009/0220338 | A1* | 9/2009 | Ietka | F04D 29/052 415/229 |
| 2010/0221128 | A1* | 9/2010 | Mellar | F04B 39/06 417/410.1 |
| 2010/0329894 | A1* | 12/2010 | Tolbert, Jr. | F04B 39/08 417/53 |
| 2011/0007990 | A1* | 1/2011 | Kawamura | C10M 115/08 384/322 |

OTHER PUBLICATIONS

Office Action in corresponding Brazil application BR112016013952-6 dated Apr. 7, 2020 (pp. 1-4 and English translation of relevant portion (pp. 1).

* cited by examiner

COMPRESSOR

TECHNICAL FIELD

The present invention relates to a compressor, in particular to a compressor having a reciprocating piston compressor.

BACKGROUND OF THE INVENTION

Mobile compressors are used for example on construction sites for manual work in which compressed air is required for connected compressed-air tools. One type of compressor that is often used is the piston compressor, in which air is sucked into one or more cylinders, compressed by a piston and discharged again as compressed air. The amount of air delivered from the piston compressors is usually adapted to the compressed air required in each case by adjusting the drive speed of the machine driving the compressor. DE 10 2004 007 882 B4 discloses for example a compressor having a compressed-air sensor, depending on the measured value of which the speed of a piston compressor is adjusted.

Due to the clocked operation thereof, piston compressors do not discharge compressed air continuously but rather generate compressed air in pulses. Conventionally, a specific compressed-air buffer volume is therefore retained in order to damp the compressed-air pulses by means of the compressor. This buffer volume is conventionally retained in separate storage containers so that compressed air at equally high pressure can be provided to a compressed-air consumer connected to the storage containers. DE 10 2009 052 510 A1 for example relates to a speed-variable piston compressor that has a lightweight and compact compressed-air tank made of plastics material.

Various other attachments are provided for the design of compressed-air tanks for piston compressors: U.S. Pat. No. 6,089,835 A for example discloses a piston compressor having a compressed-air tank that is formed by a cover housing placed on the outside of the motor housing. U.S. Pat. No. 5,370,504 A discloses a piston compressor in which the compressor cylinders are completely embedded in a storage tank for compressed air.

However, there is a need for solutions for compressors that have a lower weight and smaller dimensions so that they better suit manual transport.

SUMMARY OF THE INVENTION

According to one aspect of the invention, a compressor is therefore provided, comprising a motor, a drive shaft driven by the motor and connected thereto, a crank mechanism connected to the drive shaft, at least one compressed-air generation apparatus that is driven by the crank mechanism and is designed to generate compressed air, a crankcase that has an inner chamber wall in the shape of a hollow body, which receives the drive shaft at least in portions, an outer chamber wall that is spaced apart from the inner chamber wall radially with respect to the drive shaft, an end wall, and a dividing wall, and a compressed-air storage container that is designed to receive compressed air generated by the compressed-air generation apparatus, wherein the compressed-air storage container is formed by the inner chamber wall, the outer chamber wall, the end wall and the dividing wall.

The basic concept of the invention is that of embedding the storage container for compressed air generated by the compressor in the crankcase of the compressor by using the space around the drive shaft. In this case, it is highly advantageous that a separate storage container can be omitted, which in turn contributes to a considerable saving in terms of weight and cost. The entire structure of the compressor is more compact, and therefore the compressor remains easy to handle and portable despite having a large storage volume.

In addition, by integrating the compressed-air storage container in the crankcase, the amount of components required is reduced, which in turn simplifies assembly of the compressor. By supporting the drive shaft in an integral crankcase portion, there is also no need for the complex adjustment of the individual bearing points with respect to one another. Furthermore, components that are required for operating the compressor, for example a pressure sensor, pressure indicator, safety valve, non-return valve or drain valve can be connected to the integrated compressed-air storage container in a cost-effective manner and without additional pipes.

According to one embodiment of the compressor according to the invention, the compressor may also comprise a motor mount that receives and retains the motor and is connected to the crankcase by forming the end wall between the crankcase and the motor.

According to another embodiment of the compressor according to the invention, the compressor may also comprise at least one first bearing that supports the drive shaft and is arranged within the hollow body formed by the inner chamber wall.

In this case, the compressor may comprise at least one second bearing that supports the drive shaft. According to one variant, the second bearing may be arranged between the motor and the first bearing within the hollow body formed by the inner chamber wall. According to another variant, the second bearing may be arranged in the motor outside the hollow body formed by the inner chamber wall. The first and/or second bearing may for example be grease-lubricated rolling bearings.

According to another embodiment of the compressor according to the invention, the crankcase may be monolithically formed with the inner chamber wall, the outer chamber wall and the dividing wall. In this case, the monolithic crankcase may be designed as a light metal cast part.

According to another embodiment of the compressor according to the invention, the compressor may also have at least one brace that extends axially with respect to the drive shaft between the inner chamber wall and the outer chamber wall and divides the compressed-air storage container into at least two storage portions.

According to another embodiment of the compressor according to the invention, the at least two storage portions may be fluidically interconnected by compressed-air lines, valves and/or constrictions.

According to another embodiment of the compressor according to the invention, the compressor may also have at least one longitudinal rib that is formed integrally with the crankcase on the outside of the compressed-air storage container.

According to another embodiment of the compressor according to the invention, the compressor may also comprise a motor mount that receives and retains the motor, wherein the crankcase is formed around the motor so as to be spaced apart from the motor mount, and wherein the compressed-air storage container extends at least in part around the motor between the crankcase and the motor mount.

According to another embodiment of the compressor according to the invention, the compressed-air storage container may enclose the drive shaft within an angular range of 360°.

According to another embodiment of the compressor according to the invention, the ratio of the distance between the axis of rotation of the drive shaft and the point on the inner wall of the compressed-air storage container that is furthest perpendicularly from the drive shaft to the distance between the axis of rotation of the drive shaft and the upper dead centre of a piston of the compressed-air generation apparatus may be between 0.2 and 1.

According to another embodiment of the compressor according to the invention, the ratio of the distance between the axis of rotation of the drive shaft and the point on the inner wall of the compressed-air storage container that is furthest perpendicularly from the drive shaft to the maximum axial extent of the compressed-air storage container 25 may be between 0.3 and 2.5.

According to another embodiment of the compressor according to the invention, the compressed-air generation apparatus may have at least one compressor chamber and the volume ratio between the volume of the compressed-air storage container and the sum of the geometric working volumes of the compressor chambers of the compressed-air generation apparatus may be between 5 and 25.

BRIEF SUMMARY OF THE DRAWINGS

The invention will be described in more detail below with reference to the embodiments and the accompanying drawings.

The accompanying drawings are used in order to better understand the present invention and show variants of the invention. They are used to explain principles, advantages, technical effects and possible variations. Of course, other embodiments and many of the intended advantages of the invention are likewise conceivable, in particular with reference to the detailed description of the invention set out below. The elements in the drawings are not necessarily shown to scale and are simplified in part or shown schematically for reasons of clarity. Like reference signs denote like or similar components or elements.

Although specific embodiments are described and shown herein, it is clear to a person skilled in the art that an abundance of other, alternative and/or equivalent implementations can be selected for the embodiments, essentially without departing from the basic concept of the present invention. In general, all of the variations, modifications and deviations of the embodiments described herein should likewise be considered to be covered by the invention.

DETAILED DESCRIPTION OF THE EMBODIMENTS

Figure 1:
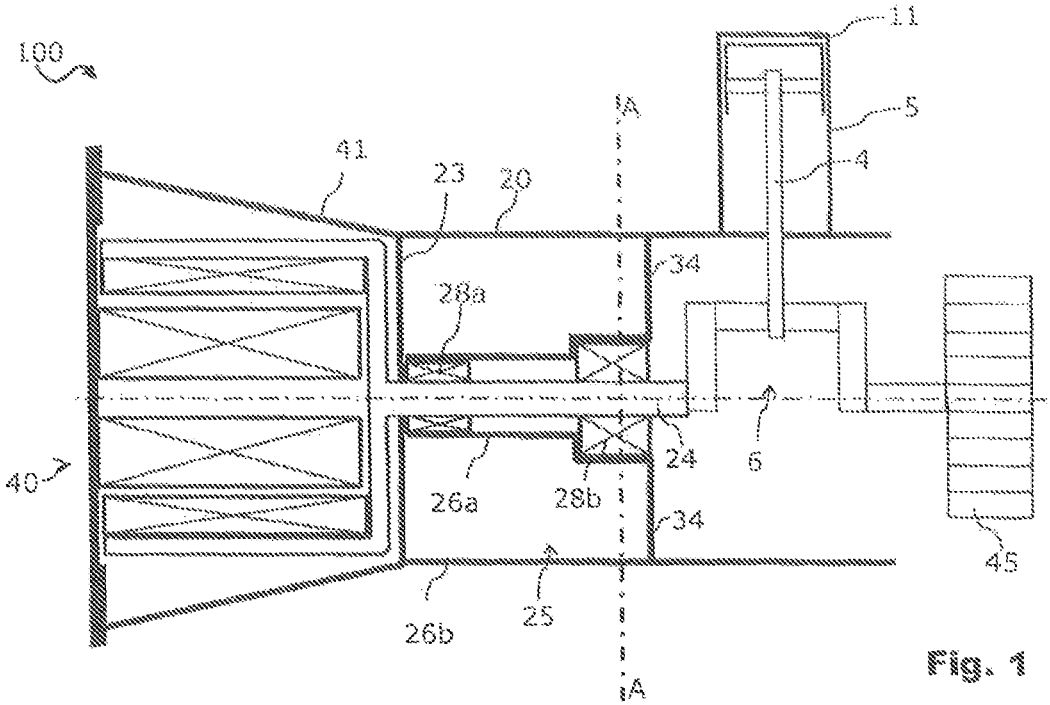
FIG. 1 is a schematic sectional view of a compressor according to one embodiment of the invention.

FIG. 1 is a schematic sectional view of a compressor 100. The compressor 100 generally has a motor 40 that can be retained in a motor mount 41. The motor 40 may for example be an electric motor having speed control. In this case, it may possible to use the synchronous motors thereof such as brushless DC motors or asynchronous motors. The motor 40 drives a drive shaft 24 that extends from the motor 40 into a crankcase 20. In this case, the drive shaft 24 may be arranged substantially concentrically with the cross section of the crankcase shape 20 in the centre thereof. The drive shaft 24 is used to drive a crank mechanism 6 that reciprocates a piston 4 in a cylinder 5, i.e. the crank mechanism 6 converts the rotational movement of the drive shaft 24 into a linear movement in the direction of extension of the piston 4 in the cylinder 5. For this purpose, the crank mechanism 6 may have a counterweight, a crank web, a connecting rod, a connecting rod bearing and/or a gudgeon pin. In this case, a compressor chamber 11 is formed at the head of the cylinder housing, in which chamber air can be compressed in accordance with the main function of the compressor 100. A fanwheel 45 may then be arranged on the crank mechanism 6.

The compressed-air storage container 25, which is formed as an integral component of the crankcase 20 in FIG. 1, is a key component of the crankcase 20. The crankcase 20 also has an inner chamber wall 26*a* that may be cylindrical, for example, with a circular or polygonal cross section and receives and supports the motor-side part of the drive shaft 24 such that it can rotate. At least one bearing 28*b* is therefore arranged in a first bearing seat inside the chamber wall 26*a*. The bearing 28*b* in the first bearing seat may support a non-motor-side part of the drive shaft 24 between the motor 40 and crank mechanism 6, i.e. the bearing 28*b* supports the crank mechanism 6 in a floating manner.

In addition, an additional bearing 28*a* may be formed in a second bearing seat inside the chamber wall 26*a* and may support a motor-side part of the drive shaft 24 between the motor 40 and crank mechanism 6, i.e. the bearing 28*a* supports the motor 40 in a floating manner. Because the two bearings 28*a* and 28*b* are in the portion of the crankcase 20 that forms the compressed-air storage container 25, the bearing seats of the bearings 28*a* and 28*b* can be better aligned to one another. This enables improved concentricity of the bearing seats with respect to one another. It is in this case possible for the two bearing seats of the bearings 28*a* and 28*b* in the crankcase 20 to be accessed from one side, in particular if the radial extent of the bearing 28*a* is less than that of the bearing 28*b*.

Figure 2:
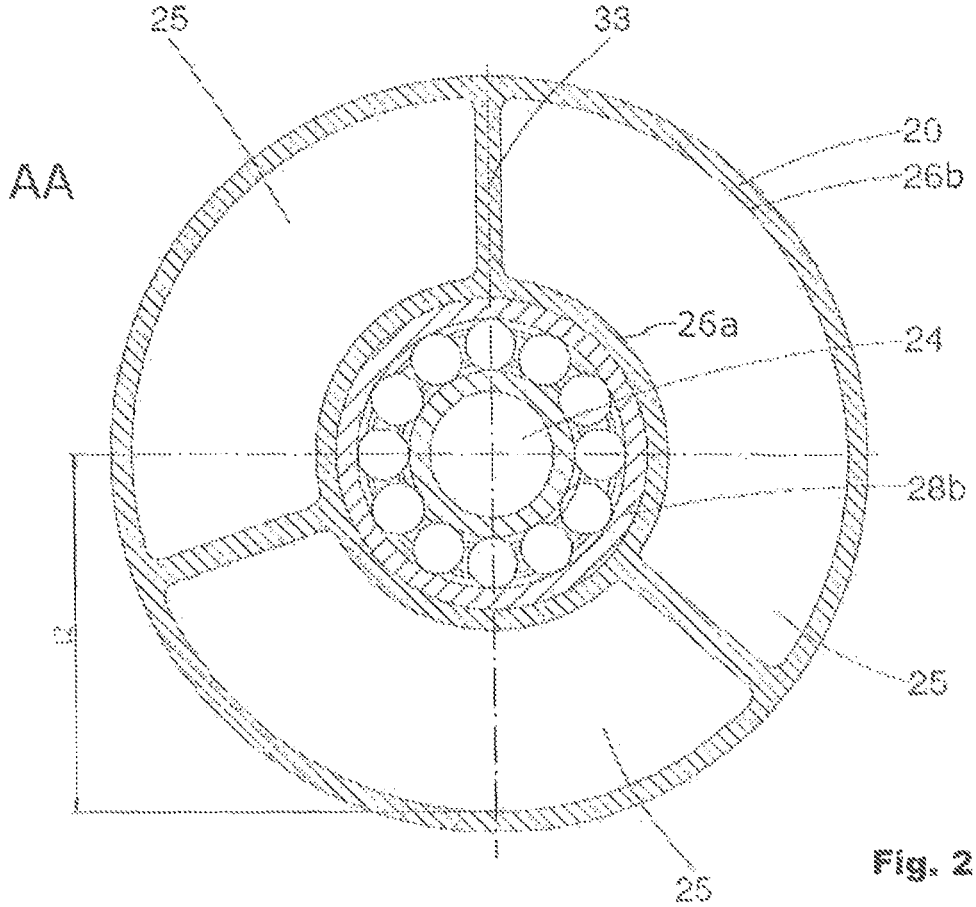
FIG. 2 is a schematic cross section through the compressor in FIG. 1.

In order to illustrate the geometry of the compressed-air storage container 25, FIG. 2 is an example of a cross section through the compressor 100 along the cross-sectional line AA in FIG. 1. The compressed-air storage container is arranged in this case so as to be substantially annular around the drive shaft 24. The compressed-air storage container 25 may enclose a minimum angle of 200°, preferably of at least 240°, around the drive shaft 24. In the example in FIG. 2, the crankcase 20 and therefore the compressed-air storage container 25 are in principle a hollow-cylindrical shape. The compressed-air storage container 25 is in this case delimited by the inner chamber wall 26*a* on one side and an outer chamber wall 26*b* on the other side in the radial direction relative to the axis of rotation of the drive shaft 24.

The outer chamber wall 26*b* is an outer wall of the crankcase 20 that completely receives the inner chamber wall 26*a* in its interior. In other words, the topology of the case formed by the outer chamber wall 26*b* and the inner chamber wall 26*a* substantially resembles two cylinders mounted inside one another, for example circular cylinders, prismatic cylinders or cylinders having a polygonal cross-sectional area. The cover areas of the cylinder shell surfaces formed between the by the outer chamber wall 26*b* and the inner chamber wall 26*a* may be enclosed by one or more dividing walls 34 on the other side or one or more end walls 23 on the other side in order to form the volume of the compressed-air storage container 25.

The dividing wall 34 or the dividing walls 34 each have a main direction of extension that substantially extends perpendicularly to the axial direction of the drive shaft 24. The end wall 23 likewise has a main direction of extension that substantially extends perpendicularly to the axial direction of the drive shaft 24 and is spaced apart from the dividing wall 34 or the dividing walls 34 by a length that substantially corresponds to the longitudinal extent of the compressed-air storage container 25.

In the lateral direction, the compressed-air storage container 25 may be divided by one or more braces 33. In this way, the compressed-air storage container 25 can be stabilised on the one hand and can be divided into a plurality of partial storage volumes on the other hand. Said partial storage volumes may be interconnected via compressed-air lines or other connection lines such as constrictions. Advantageously, compressed-air coolers and/or valves may also be arranged in the connection lines. In the example in FIG. 2, three braces 33 are shown that divide the completely surrounding compressed-air storage container 25 into three equal partial storage volumes that each cover 120° of the crankcase 20. Of course, other divisions with more or fewer partial storage volumes or an asymmetrical division are likewise possible. The braces 33 may for example be integrally formed with the crankcase 20, for example in a common metal cast part.

Figure 3:
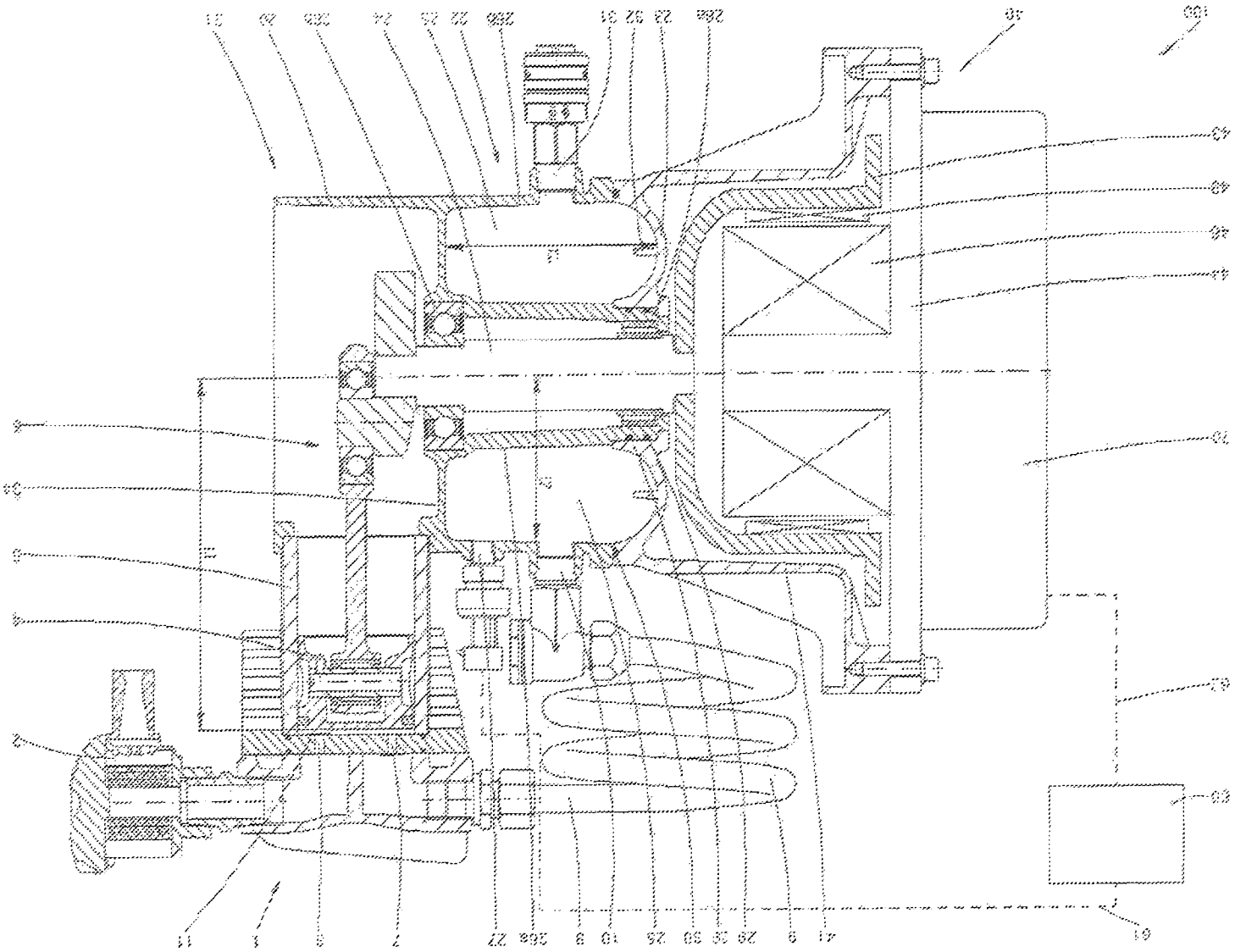
FIG. 3 is a detailed view of the compressor in FIG. 1 according to another embodiment of the invention.

FIG. 3 is a detailed longitudinal section through the compressor 100 in FIG. 1. The compressor 100 is shown in the example in FIG. 3 as a dry-compressing speed-variable piston compressor 100 that works in accordance with the principle of reciprocating piston compression. In this case, however, it is likewise possible to use an oil-lubricated compressor instead of a dry-compressing compressor. The compression can in this case, as shown by way of example in FIG. 3, take place in one stage; however, it may also be possible to carry out the compression in a plurality of stages.

The compressor according to FIG. 3, in a compressor portion 1 on the right-hand side of the figure, has a cylinder 5 in which a piston 4 is arranged in order to compress air from the surroundings. Air from the surroundings can be sucked through an intake air filter 2 into the compression chamber 11 via an inlet opening 3 having an inlet valve. This takes place when the piston 4 moves downwards.

The linear working movement for the piston 5 is produced by a crank mechanism 6 that is connected to the rotor 43 of the motor 40 by means of a drive shaft 24. The drive shaft 24 may be mounted so as to rotate relative to the crankcase 20 by means of two bearings 28*a* and 28*b*, for example prelubricated rolling bearings having fixed/floating bearings. The crankcase 20 has a crank mechanism portion 21 that encloses the crank mechanism 6 at least in part and has a storage portion 22 that adjoins the crank mechanism portion 21 and is arranged axially between said portion and the motor 40.

It is preferably provided for the dividing wall 34 to separate the compressed-air storage container 25 from the crank mechanism 21 inside the crankcase 20, i.e. the crank mechanism 6 itself is not located in the air storage volume of the compressed-air storage container 25. The storage portion 22 is therefore disjointedly formed with the crank mechanism portion 21. In particular, it is also provided for the cylinder 5 and the piston 4 not to be arranged inside the storage portion 22, i.e. for the volume of the compressed-air storage container not to include the cylinder 5 and the piston 4.

The storage portion 22 has an inner chamber wall 26*a* that is hollow or tubular in order to be arranged around the drive shaft 24 and receives the region of the drive shaft 24 leading through the storage portion 22 and at least one of the two bearings 28*a* and 28*b*. The inner chamber wall 26*a* may have recesses for one or more bearing seats of the bearings 28*a* and 28*b*. Furthermore, more than two bearings 28*a* and 28*b* may be provided.

Furthermore, the storage portion 22 has an outer chamber wall 26*b* that may be arranged so as to be concentric around the inner chamber wall 26*a* and spaced apart therefrom. Preferably, the inner chamber wall 26*a* and the outer chamber wall 26*b* are integrally formed with the crankcase 20, i.e. formed as an integral portion of the crankcase 20.

The inner chamber wall 26*a* and the outer chamber wall 26*b* define, together with one or more dividing walls 34, the extension plane of which extends substantially perpendicularly to the axis of rotation of the drive shaft 24, a compressed-air storage container 25 of the compressor 100. The compressed-air storage container 25 is arranged annularly around the inner chamber wall 26*a* at least in portions so as to be concentric with the drive shaft 24. In other words, the compressed-air storage container 25 therefore surrounds the drive shaft 24 at least in a partial angular range. In the example in FIG. 3, the compressed-air storage container 25 is arranged completely, i.e. in an angular range of 360°, around the drive shaft 24. However, it may also be possible to provide only partial angular ranges of less than 360° around the drive shaft 24 in which angular chambers are defined by the chamber walls 26*a* and 26*b* and the dividing walls 34 for the function of the compressed-air storage container 25. On the motor side, the compressed-air storage container 25 is tightly sealed with respect to the motor region or the motor mount 41 by an end wall 23 of the crankcase 20. The compressed-air storage container 25 thus defines a control volume that is used to receive and temporarily store compressed air generated by the piston compressor by means of the corresponding dimensions of the chamber walls 26*a* and 26*b* and the axial distance L3 between the dividing walls 34 and the end wall 23 of the crankcase 20.

The motor mount 41 may assume the function of supporting the torque between the rotor and stator of the motor 40. The motor mount 41 may be a component that completely or only partially surrounds the motor 40 and may have closed bordering walls having braces, columns or the like. In this case, the motor mount 41 may also act as a completely closed motor housing.

The motor mount 41 may in addition form the end wall 23, which is arranged between the motor 40 and the storage portion 22 in the example in FIG. 3. However, it may also be provided for the end wall 23 to be arranged on the outside of the motor 40 so that the motor 40 is contained at least in part by the storage portion 22, i.e. that the volume of the compressed-air storage container 25 extends at least in part in the axial direction of the drive shaft 24, completely or in a partial angular range around the motor 40.

After a suction cycle of the piston 4, the sucked-in air is compressed in the compression chamber 11 in a compression cycle when the piston 4 moves upwards and is output via the outlet opening 7 and an outlet valve arranged therein. The compressed air that is discharged via the outlet opening 7 may be output into a compressed-air line 8 that may comprise a region having a cooling line 9 for cooling purposes. The compressed air passes via the cooling line 9 through the non-return valve 10 to reach a compressed-air storage container 25 of the compressor 100.

Sealing with respect to the surroundings may expediently take place by means of seals 29 and 30, for example O-rings. Both the crankcase 20 and the motor mount 41 may be reinforced by ribs 32. Said ribs 32, which can be attached to the outside of the crankcase 20 and/or of the motor mount 41 in a similar manner, contribute to better heat dissipation from the compressed air. In addition, it is possible to optimise the mechanical stability of the compressor 100 in this way.

A compressed-air discharge line, for example a compressed-air tube for a tool operated by compressed air through which the compressed air may be extracted as required from the compressed-air storage container 25, may be connected via a compressed-air coupling 31.

When the compressor is in operation, a compressor controller 60 may retrieve the pressure of the compressed air that is measured by a pressure sensor 27 arranged on the compressed-air storage container 25 via a control line 61. If the measured target pressure in the compressed-air storage container 25 deviates from the target pressure stored in the compressor controller 60, a target speed signal for the motor 40 can be determined from the control deviation, which signal is sent by the compressor controller 60 as an actuation signal via a control line 62 to a motor controller, for example to the frequency converter 70 of an electric motor 40. The frequency converter 70 controls the speed of the motor 40 depending on the sent actuation signal.

When the speed of the motor 40 is adjusted and the amount of delivered air from the compressor 100 is adapted as a result, it is advantageous for the size of the compressed-air storage container 25 to be able to be reduced while the switching frequency remains the same. As an alternative, it is likewise possible to reduce the switching frequency while the size of the compressed-air storage container 25 remains the same. By adjusting the speed, it is moreover advantageously possible to reduce the minimum amount of delivered air from the compressor, which in turn can lead to a smaller size of the compressed-air storage container 25 or a lower switching frequency. Finally, it is also possible to fill the compressed-air storage container 25 more rapidly after an idle phase, in particular if the compressor 100 is operated in a speed-adjusted manner and can provide a greater amount of delivered air at a low pressure.

In the example in FIG. 3, the motor 40 is an electronically commutated synchronous external rotor motor in which a frequency converter 70 is directly attached to the stator 44. The stator 44 bears the stator winding 46 and may for example be connected to the motor mount 41 by screws. The torque required for the compression of the compressor 100 is generated by the alternating magnetic field generated in the stator winding 46 in a known manner by interaction with the permanent magnets 48 in the rotor 43 of the motor 40.

Figure 4:
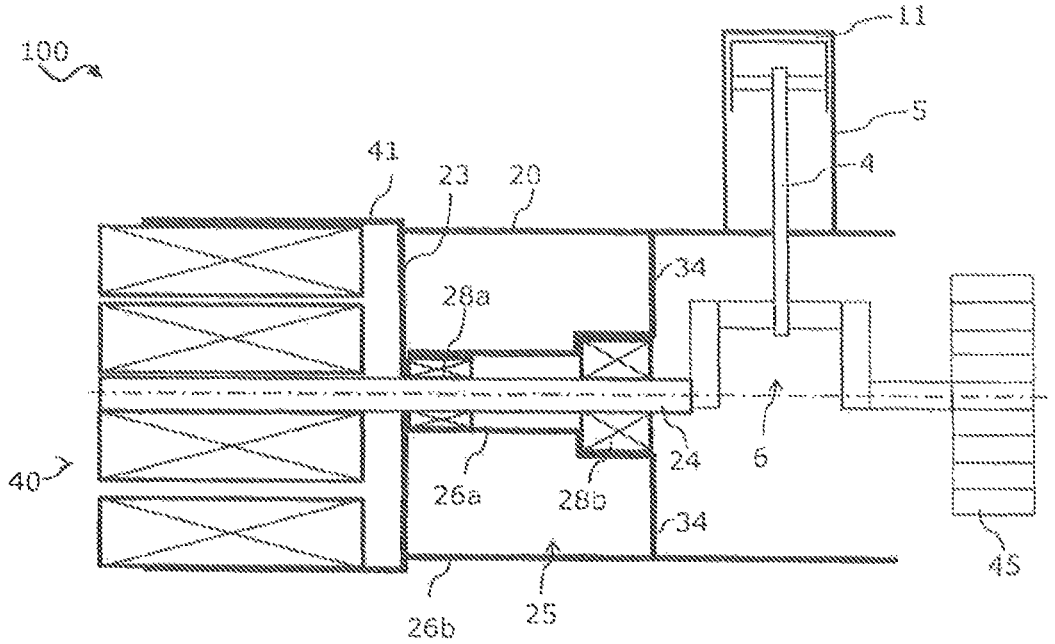
FIG. 4 is a schematic sectional view of a compressor according to another embodiment of the invention.
Figure 5:
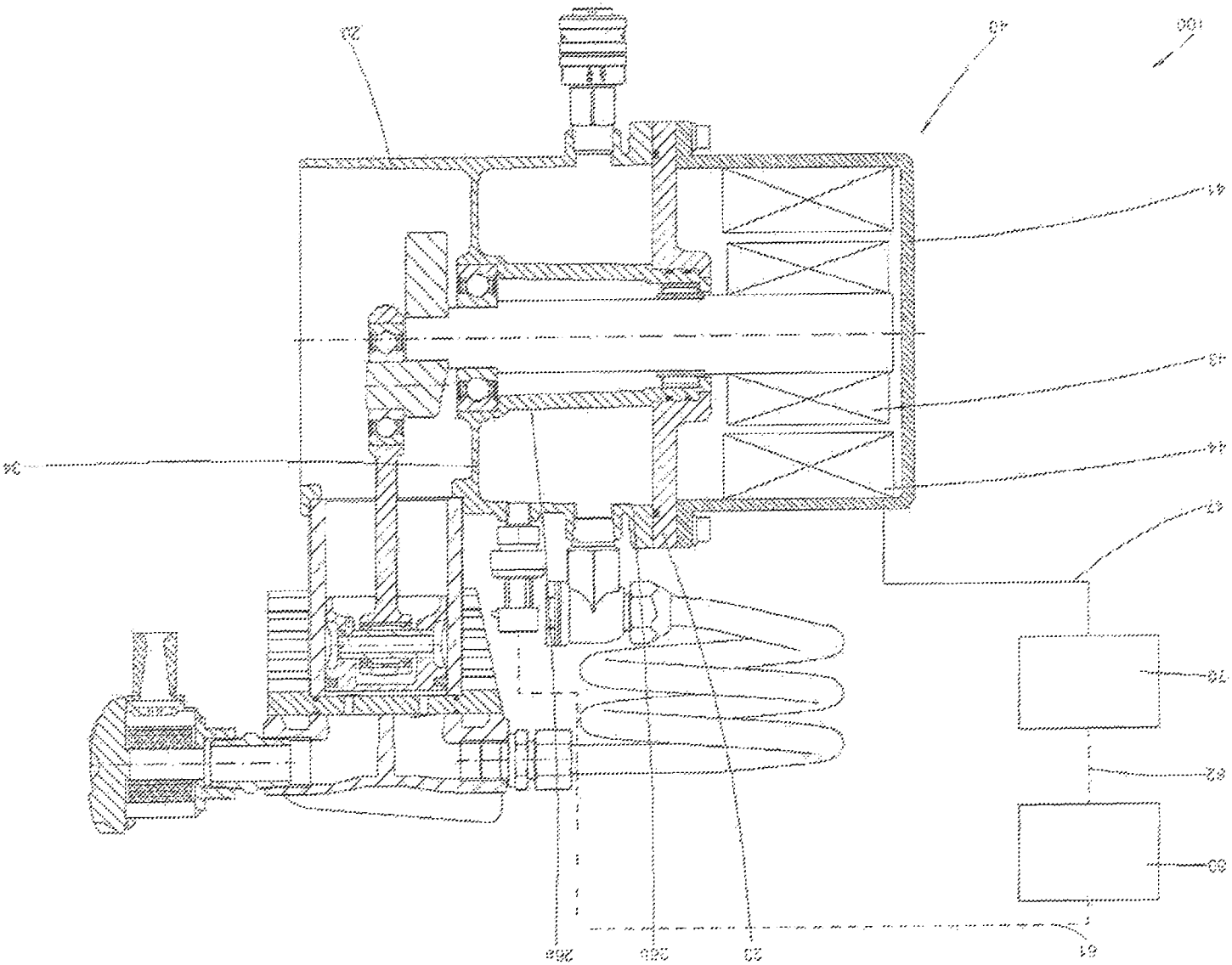
FIG. 5 is a detailed view of the compressor in FIG. 4 according to another embodiment of the invention.

FIG. 4 is a longitudinal section through a compact speed-variable piston compressor 100 having an alternative motor construction. Said compressor differs from the compressor 100 in FIG. 1 substantially in that the motor 40 is an internal rotor motor having an external frequency converter. FIG. 5 shows a more detailed view of the compressor from FIG. 4. In this case, the motor 40 has an external frequency converter 70 that is connected to the motor 40 via a motor connection cable 47. If, for assembly reasons, the motor 40 cannot be attached to the crankcase 20 by means of the motor mount 41, a cover can additionally be provided as the end wall 23 in the case of the compressor from FIG. 5. The cover 23 may attach the motor 40 to the motor mount 41, which can then assume a housing function for the motor 40. The cover 23 can also fluidically seal the compressed-air storage container 25, which is located in the crankcase 20.

Both for the compressor 100 in FIGS. 1 to 3 and the compressor 100 in FIGS. 4 and 5, the maximum radial extent L2 (distance between the axis of rotation of the drive shaft 24 and the point on the inner wall of the compressed-air storage container 25 that is furthest perpendicularly from the drive shaft 24) may be in a specific ratio to the compressor length L1 (distance between the axis of rotation of the drive shaft 24 and the upper dead centre of the piston). In the simplest case, the extent L2 may be smaller than or equal to the compressor length L1. A ratio of L2/L1≤2/3 is advantageous. The ratio L2/L1 may in this case be between 0.2 and 1, preferably between 0.4 and 0.66. In absolute terms, the extent L2 may be smaller than 150 mm, in order to ensure the compactness and therefore the portability of the compressor 100 for example.

The maximum radial extent L2 may also be in a specific ratio to the maximum axial extent L3 of the compressed-air storage container 25. If the compressed-air storage container 25 is arranged between the crank mechanism 6 and the motor 40, the ratio L2/L3 may be between 0.3 and 2.5, preferably between 0.5 and 1.33.

In addition, the volume ratio between the volume $V_R$ of the compressed-air storage container 25 and the geometric working volume $V_H$ of the compressor chamber 11 (or the sum $V_H$ of all the working volumes $V_{Hi}$ of all the compressor chambers 11 in the case of a plurality of cylinder 5) can be set in order to be able to eliminate the damping of the compressed-air pulses in an optimum manner. The ratio $V_R/V_H$ may in this case be between 5 and 25.

The crankcase 20 including all the chamber walls 26*a*, 26*b* and end walls 23 and dividing walls 34 may be entirely formed in one piece in FIGS. 1 to 5, for example by a dead-mould casting method or a rapid prototyping method such as selective laser melting, 3D printing, additive layer manufacturing, electron beam melting, laser deposition welding or similar methods. Alternatively, it may also be possible for the chamber walls 26*a*, 26*b* to be composed of a plurality of parts that are sealed with respect to one another and interconnected, for example screwed together. The crankcase 20 and the relevant components thereof, such as walls, dividing walls and end walls, may for example be produced in a pressure die casting method, for example from a light metal such as aluminium or magnesium.

Figure 6:
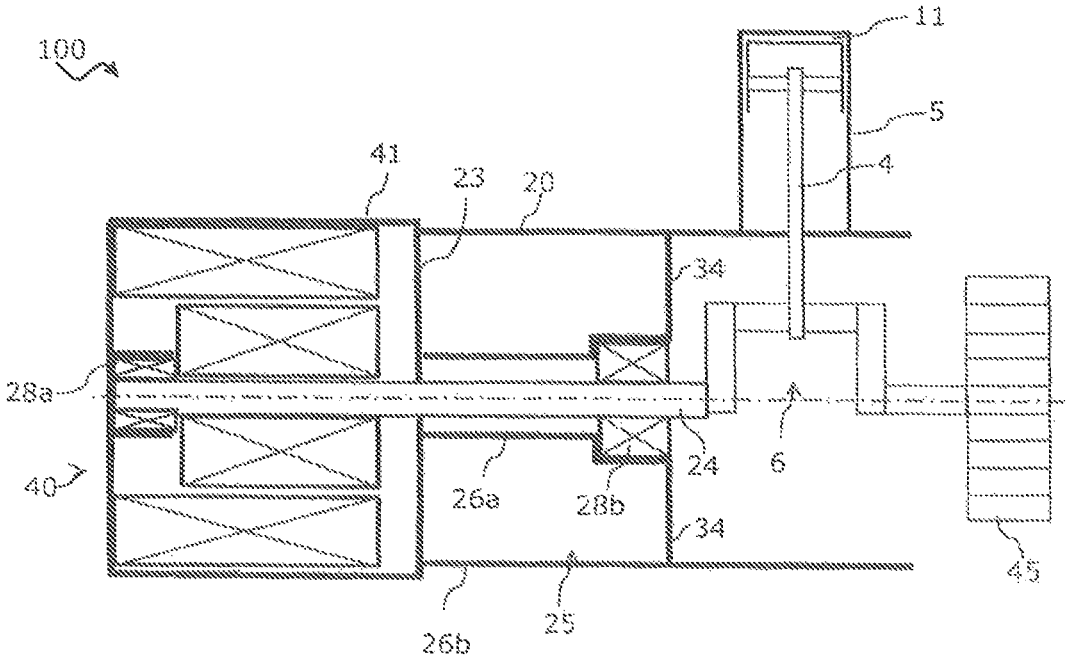
FIG. 6 is a schematic sectional view of a compressor according to another embodiment of the invention.
Figure 7:
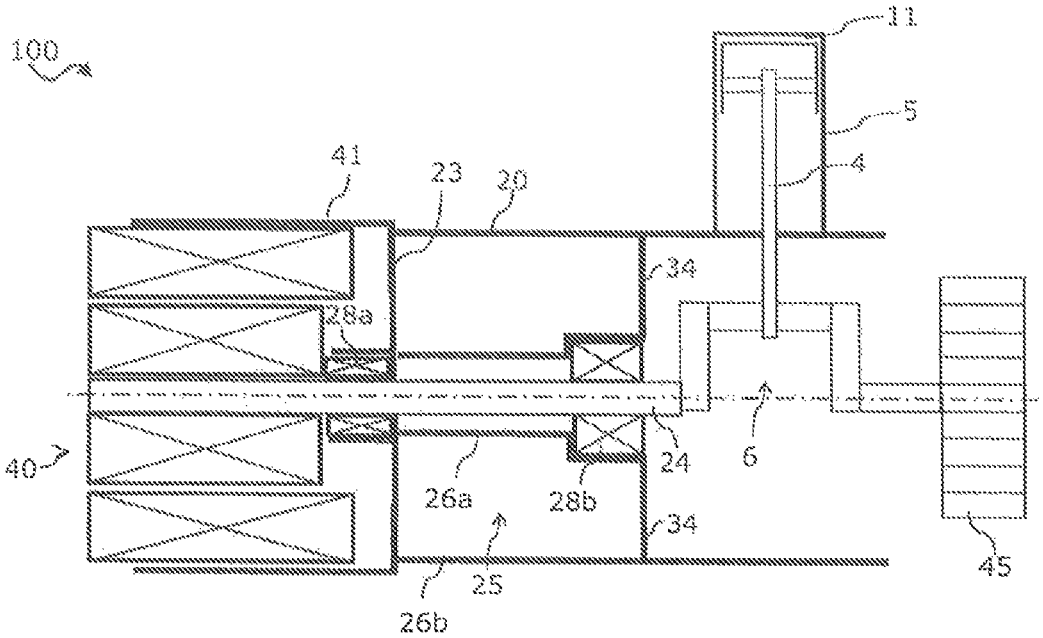
FIG. 7 is a schematic sectional view of a compressor according to another embodiment of the invention.
Figure 8:
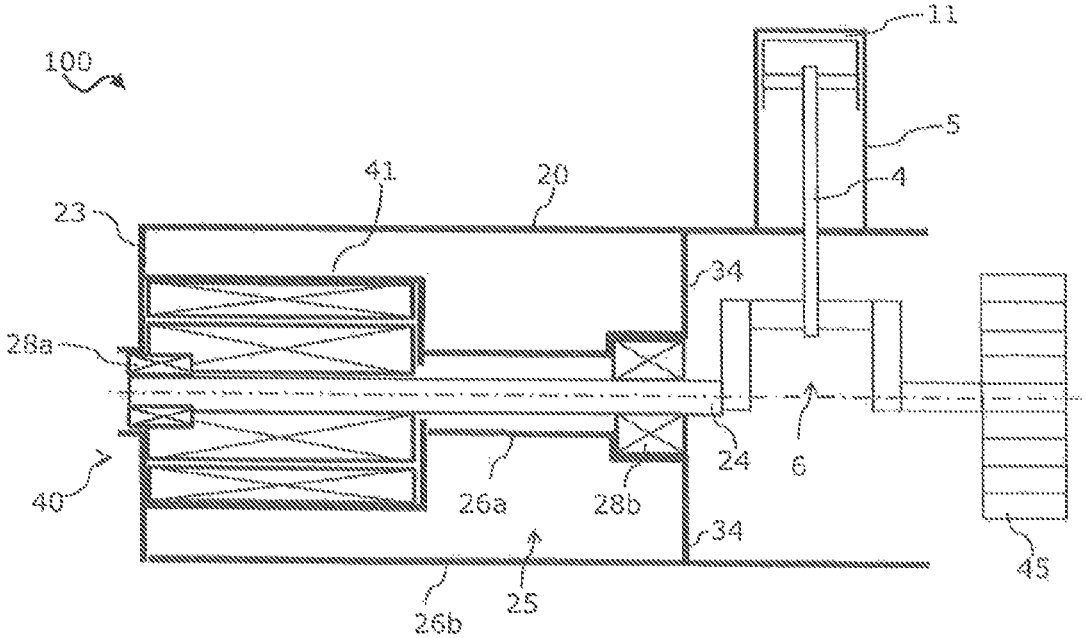
FIG. 8 is a schematic sectional view of a compressor according to another embodiment of the invention.

FIGS. 6, 7 and 8 are schematic views of additional variants of a compressor 100. The compressors 100 in FIGS. 6 and 7 differ from the compressors 100 in FIGS. 1 and 4 substantially in that the second bearing 28*a* is housed in the motor 40 whereas in FIG. 6 is it on the non-crankcase-side of the motor 40 and in FIG. 7 it is on the crankcase-side of the motor 40. The compressor 100 in FIG. 8 has a crankcase 20 that together with the motor mount 41 forms a compressed-air storage container 25 that is extended axially with respect to the drive shaft. The compressed-air storage container 25 extends around the motor 40 inside the crankcase 20, which is correspondingly spaced apart from the motor mount 41. In this case, the ratio L2/L1 of the maximum radial extent L2 to the maximum axial extent L1 of the compressed-air storage container 25 is between 0.12 and 1, preferably between 0.2 and 0.5.

The compressed-air storage container 25 may enclose the motor 40 in a partial angular range of less than 360° or completely, i.e. over a circumference of 360°. It may also be possible for the compressed-air storage container 25 to completely enclose the motor 40 relative to the angular range around the drive shaft 24, but to only partially enclose the motor 40 in the axial direction of the axis of rotation of the motor, i.e. is not completely formed up to the non-crankcase-end of the motor mount 40.

What is claimed is:

1. A compressor, comprising:
a motor;
a drive shaft driven by the motor and connected thereto;
a crank mechanism connected to the drive shaft;
at least one compressed-air generation apparatus that is driven by the crank mechanism and is designed to generate compressed air;
a crankcase that has
an inner chamber wall in the shape of a hollow body, which receives at least a portion of the drive shaft,
an outer chamber wall that is spaced apart from the inner chamber wall radially with respect to the drive shaft,
an end wall and
a dividing wall;
a compressed-air storage container that is designed to receive compressed air generated by the compressed-air generation apparatus, wherein the compressed-air storage container is formed by the inner chamber wall, the outer chamber wall, the end wall and the dividing wall;
at least one first bearing that supports the drive shaft and is arranged within the hollow body formed by the inner chamber wall; and
at least one second bearing that supports the drive shaft and is arranged between the motor and the first bearing within the hollow body formed by the inner chamber wall.

2. The compressor according to claim 1, wherein the crankcase is monolithically formed with the inner chamber wall, the outer chamber wall and the dividing wall.

3. The compressor according to claim 2, wherein the monolithic crankcase is designed as a light metal cast part.

4. The compressor according to claim 1, further comprising:
at least one brace that extends axially with respect to the drive shaft between the inner chamber wall and the outer chamber wall.

5. The compressor according to claim 4, wherein the at least one brace divides the compressed-air storage container into at least two storage portions.

6. The compressor according to claim 5, wherein the at least two storage portions are fluidically interconnected by compressed-air lines, valves and/or constrictions.

7. The compressor according to claim 1, further comprising:
a motor mount that receives the motor,
wherein the crankcase is formed around the motor so as to be spaced apart from the motor mount, and
wherein the compressed-air storage container extends at least in part around the motor between the crankcase and the motor mount.

8. The compressor according to claim 1, wherein the end wall is arranged in the axial direction of the drive shaft between the crankcase and the motor.

9. The compressor according to claim 1, wherein the compressed-air storage container encloses the drive shaft within an angular range of 360°.

10. The compressor according to claim 1, wherein a ratio of a distance between an axis of rotation of the drive shaft and a point on the inner wall of the compressed-air storage container that is furthest perpendicularly from the drive shaft to a distance between the axis of rotation of the drive shaft and an upper dead centre of a piston of the compressed-air generation apparatus is between 0.2 and 1.

11. The compressor according to claim 1, wherein a ratio of a distance between an axis of rotation of the drive shaft and a point on the inner wall of the compressed-air storage container that is furthest perpendicularly from the drive shaft to a maximum axial extent of the compressed-air storage container is between 0.3 and 2.5.

12. The compressor according to claim 1, wherein the compressed-air generation apparatus has at least one compressor chamber and wherein a volume ratio between a volume of the compressed-air storage container and a sum of geometric working volumes of the compressor chambers of the compressed-air generation apparatus is between 5 and 25.

13. The compressor according to claim 1, wherein the motor is a speed-variable electric motor and wherein the compressor further comprises:
a compressor controller that is designed to send an actuation signal in order to adjust the speed of the motor depending on a control deviation of the actual pressure in the compressed-air storage container from a target pressure stored in the compressor controller.

14. The compressor according to claim 13, wherein the motor is an electronically commutated synchronous external rotor motor that has a frequency converter which is directly attached to a stator of the motor and is designed to receive the actuation signal for adjusting the speed of the motor from the compressor controller.

15. The compressor according to claim 13, wherein the motor is an internal rotor motor, and wherein the compressor further comprises:
a frequency converter that is connected to the motor via a motor connection cable and is designed to receive the actuation signal for adjusting the speed of the motor from the compressor controller.

16. The compressor according to claim 1, further comprising a motor mount that receives the motor and is connected to the crankcase by forming the end wall between the crankcase and the motor.

17. A compressor, comprising:
a motor;
a drive shaft driven by the motor and connected thereto;
a crank mechanism connected to the drive shaft;
at least one compressed-air generation apparatus that is driven by the crank mechanism and is designed to generate compressed air;
a crankcase that has
an inner chamber wall in the shape of a hollow body, which receives at least a portion of the drive shaft,
an outer chamber wall that is spaced apart from the inner chamber wall radially with respect to the drive shaft, an end wall, and a dividing wall;

a compressed-air storage container that is designed to receive compressed air generated by the compressed-air generation apparatus, wherein the compressed-air storage container is formed by the inner chamber wall, the outer chamber wall, the end wall, and the dividing wall; and at least one first bearing that supports the drive shaft and is arranged within the hollow body formed by the inner chamber wall, connecting the drive shaft to the inner chamber wall, wherein the at least one first bearing is a rolling bearing.

18. The compressor according to claim 17, wherein the rolling bearing is grease-lubricated.

* * * * *